US005162786A

United States Patent [19]

Fukuda

[11] Patent Number: 5,162,786

[45] Date of Patent: Nov. 10, 1992

[54] DRIVING CIRCUIT OF A LIQUID CRYSTAL DISPLAY

[75] Inventor: Hidenori Fukuda, Yaita, Japan

[73] Assignee: Sharp Corporation, Osaka, Japan

[21] Appl. No.: 619,239

[22] Filed: Nov. 28, 1990

[30] Foreign Application Priority Data

Dec. 14, 1989 [JP] Japan ..... 1-324639

[51] Int. Cl.[5] ..... G09G 3/36

[52] U.S. Cl. ..... 340/784; 340/793

[58] Field of Search ..... 340/784, 784 A, 784 B, 340/784 C, 784 D, , 784 E, 784 F, 793, 767, 765; 350/332, 333; 341/152; 358/241, 230

[56] References Cited

U.S. PATENT DOCUMENTS

| | | | |
|---|---|---|---|
| 4,210,934 | 7/1980 | Kutaragi | 358/241 |
| 4,590,457 | 5/1986 | Amir | 341/152 |
| 4,743,096 | 5/1988 | Wakai et al. | 350/333 |
| 4,859,998 | 8/1989 | Kawamura et al. | 340/784 B |

FOREIGN PATENT DOCUMENTS

| | | |
|---|---|---|
| 63-182695 | 7/1988 | Japan . |
| 63-186295 | 8/1988 | Japan . |

OTHER PUBLICATIONS

"Electronic Circuits" Donald L. Shilling McGraw-Hill Book Company 1979 pp. 664–665.

*Primary Examiner*—Ulysses Weldon
*Assistant Examiner*—Doon Yue Chow
*Attorney, Agent, or Firm*—David G. Conlin; Robert F. O'Connell

[57] ABSTRACT

A driving circuit of a liquid crystal display for driving source lines of an active-matrix type liquid crystal display having a thin film transistor matrix array comprising a shift register circuit for sequentially storing digital video signals for one line, each of the digital video signals being comprised of pixel data of a series of predetermined bits, a latch circuit for holding for one horizontal period the digital video signals for one line stored in the shift register circuit, a conversion circuit for classifying each pixel data constituting the digital video signals for one line outputted from the latch circuit into upper and lower bits, selecting adjacent two different DC voltages according to a value designated by the upper bits, performing pulse width modulation between the two different DC voltages according to a value designated by the lower bits and supplying analog video signals to the corresponding source lines of the matrix array, and a comparison data generating circuit for outputting comparison data which has bits by number equal to that of the lower bits and is compared with the lower bits to the conversion circuit.

5 Claims, 8 Drawing Sheets

DRIVING CIRCUIT OF A LIQUID CRYSTAL DISPLAY

BACKGROUND OF THE INVENTION

1. Field of the Invention

The present invention relates to a driving circuit for driving source lines of an active-matrix type liquid crystal display having a thin film transistor matrix array (TFT array).

2. Description of the Prior Art

Conventionally, there has been proposed a circuit for driving source lines of an active-matrix type liquid crystal display as shown in FIG. 6.

In FIG. 6, the reference numeral 21 denotes a timing generating circuit. The timing generating circuit 21 receives horizontal and vertical synchronizing signals HD and VD as reference timing signals. The horizontal and vertical synchronizing signals HD and VD are synchronized with analog video signals to be described below.

A shift register circuit 22 receives sampling clocks CK and start pulses P ST from the timing generating circuit 21.

Analog video signals SVa are supplied to a sampling gate circuit 23. The gate circuit 23 has a plurality of gate portions. The gate portions sample the video signals Sva to obtain pixel signals. In addition, the gate portions receive gate pulses P SG from the shift register circuit 22 to sample the pixel signals for one line for each horizontal period.

A latch gate circuit 24 receives the pixel signals for one line which are sampled by the gate circuit 23. Latch pulses P LG are supplied from the timing generating circuit 21 to the gate circuit 24 for a horizontal blanking period. Consequently, the pixel signals for one line supplied from the gate circuit 23 are latched and held for a next horizontal period.

The pixel signals for one line outputted from the gate circuit 24 are simultaneously supplied to corresponding source lines ls of a TFT array 10 through an output circuit 25.

FIG. 7 is a diagram showing a specific partial construction of the gate circuits 23 and 24 and the output circuit 25 corresponding to one pixel signal. In other words, the whole of the gate circuits 23 and 24 and the output circuit 25 consists of the predetermined number of the above constructions. The reference numerals G23 and G24 denote gates. The reference numerals C23 and C24 denote capacitors. The reference numeral A25 denotes a buffer.

Returning to FIG. 6, the timing generating circuit 21 supplies control signals to a gate driving circuit 26. Then, scanning pulses are sequentially supplied to gate lines lg. The gate lines lg are arranged in positions corresponding to the pixel signals for one line which are supplied to the source lines ls of the TFT array 10 through the output circuit 25.

According to the driving circuit shown in FIG. 6, the analog video signals SVa are inputted. Therefore, if the number of pixels for one line is increased like the TFT array 10 having a large screen and high quality of image, a sampling time which is allowed for one pixel signal becomes shorter. Consequently, the time for charging the capacitor C23 of the gate circuit 23 becomes insufficient so that the video signals SVa cannot be sampled accurately. In other words, the TFT array 10 cannot accurately be driven corresponding to the video signals SVa. Therefore, it is difficult to obtain the good quality of display.

Japanese Unexamined Patent Publication Nos. 63-182695 and 63-186295 have disclosed a circuit for driving the liquid crystal display in response to digital video signals. In the former Publication disclosed is a driving circuit for selecting driving voltages corresponding to inputted multigradation digital video signals to output the same to the liquid crystal display. In the latter Publication disclosed is a driving circuit for receiving data which specifies a display brightness for each pixel of the liquid crystal display on the basis of a value represented by a plurality of bits and then outputting a driving signal having a pulse width corresponding to the data.

SUMMARY OF THE INVENTION

The present invention provides a driving circuit of a liquid crystal display for driving source lines of an active-matrix type liquid crystal display having a thin film transistor matrix array comprising a shift register circuit for sequentially storing digital video signals for one line, each of the digital video signals being comprised of pixel data of a series of predetermined bits, a latch circuit for holding for one horizontal period the digital video signals for one line stored in the shift register circuit, a conversion circuit for classifying each pixel data constituting the digital video signals for one line outputted from the latch circuit into upper and lower bits, selecting adjacent two different DC voltages according to a value designated by the upper bits, performing pulse width modulation between the two different DC voltages according to a value designated by the lower bits and supplying analog video signals to the corresponding source lines of the matrix array, and a comparison data generating circuit for outputting comparison data which has bits by number equal to that of the lower bits and is compared with the lower bits to the conversion circuit.

DETAILED DESCRIPTION OF THE PREFERRED EMBODIMENTS

A driving circuit of a liquid crystal display according to the present invention comprises a timing generating circuit, a gate driving circuit, an output circuit and a power circuit basically. The timing generating circuit outputs signals for judging a timing of signal processing. The gate driving circuit drives gate lines of a thin film transistor matrix array (TFT array) of an active-matrix type liquid crystal display to be driven. The output circuit properly levels analog video signals to be supplied to source lines of the TFT array. The power circuit outputs DC voltages.

According to the driving circuit, digital video signals for one line are sequentially stored in a shift register circuit, held by a latch circuit for one horizontal period and then converted into the analog video signals by a conversion circuit so as to be supplied to the source lines of the TFT array. Unlike a conventional example, there is not performed a processing in which pixel signals are sampled from the analog video signals. Consequently, even if the number of pixels for one line is increased, the TFT array can sufficiently and accurately be driven corresponding to the video signals.

An example of an active-matrix type liquid crystal display which can be driven by the driving circuit of the present invention is such that pixel electrodes are formed like a matrix in a liquid crystal cell and thin film transistors are respectively connected to the respective pixel electrodes in order to or not to apply voltages thereto so that a thin film transistor matrix array is formed (for example, Japanese Unexamined Patent Publication No. 59492/1986).

There will be described one embodiment of the present invention with reference to FIG. 1.

Figure 1:
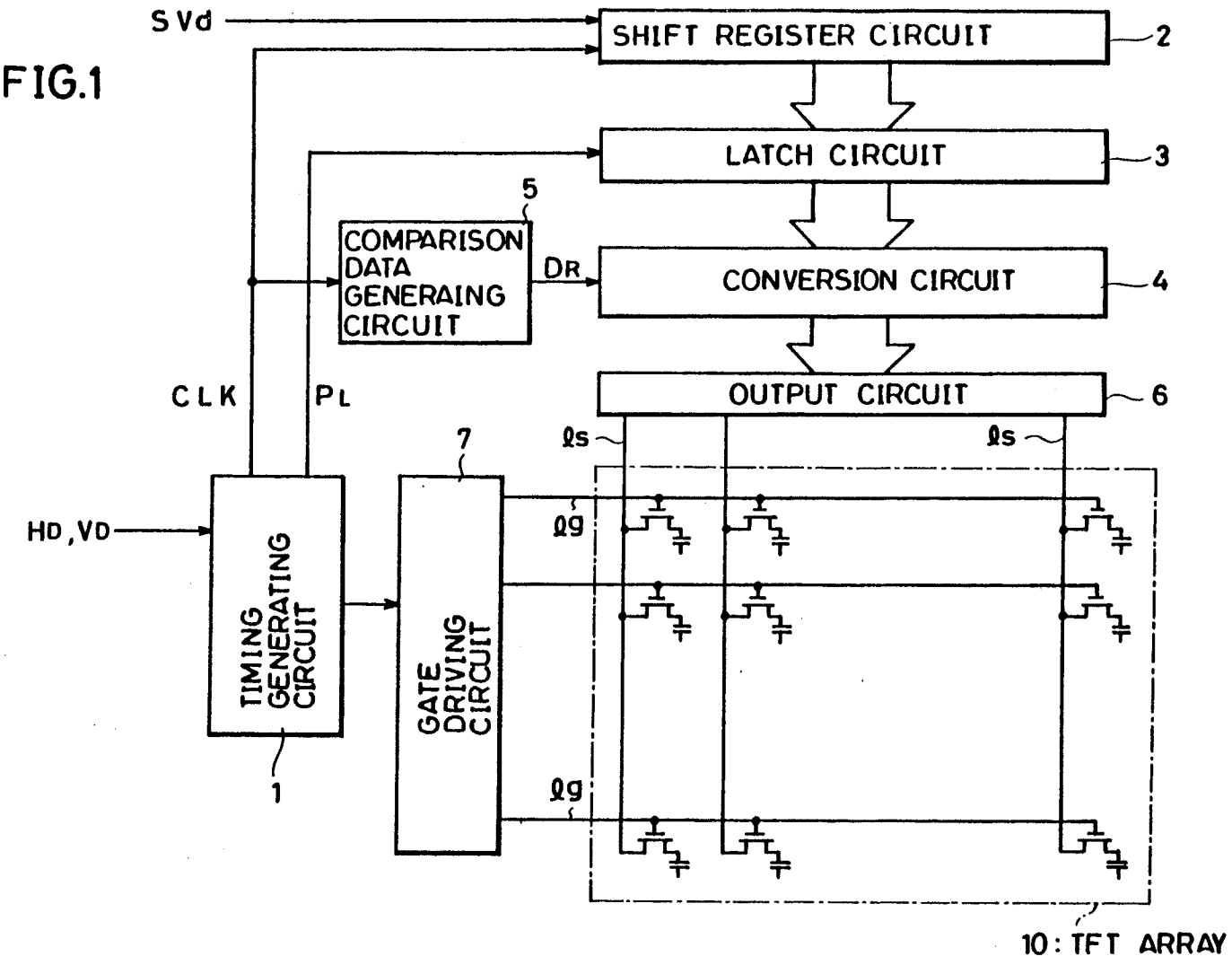
FIG. 1 is a block diagram showing one embodiment of the present invention.

In FIG. 1, the reference numeral 1 denotes a timing generating circuit. The timing generating circuit 1 receives horizontal and vertical synchronizing signals HD and VD as reference timing signals. The horizontal and vertical synchronizing signals HD and VD are synchronized with digital video signals SVd to be described below.

Figure 2A:
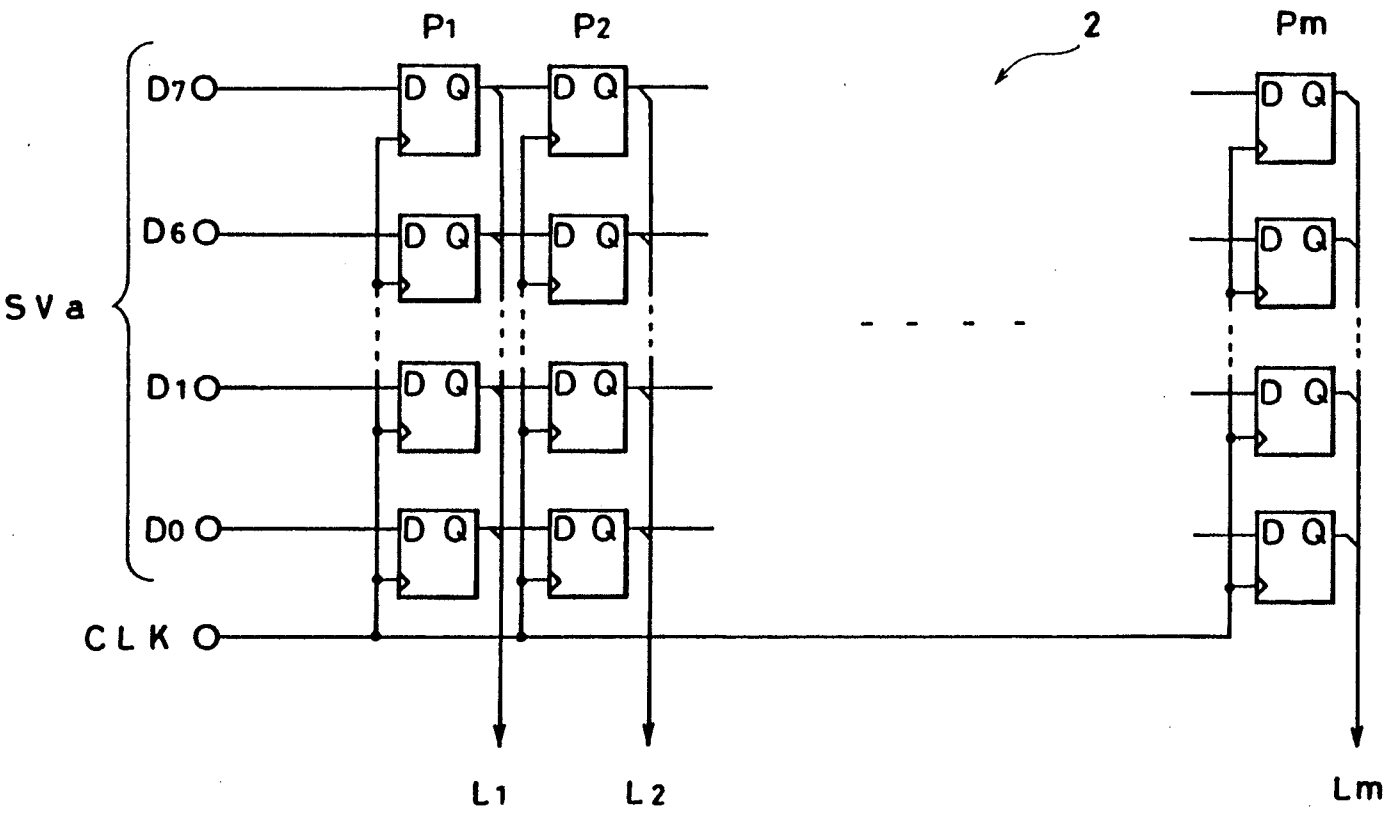
FIGS. 2A and B are circuit diagrams showing constructions of a shift register circuit, a latch circuit and a conversion circuit.

The reference numeral 2 denotes a shift register circuit. The shift register circuit 2 sequentially stores the digital video signals for one line which are comprised of pixel data of a series of predetermined bits. In addition, the shift register circuit 2 receives the digital video signals SVd. The digital video signal SVd is comprised of pixel data Pl to Pm which have 8 bits of D0 to D7 respectively. The shift register circuit 2 receives clocks CLK from the timing generating circuit 1 and sequentially stores the digital video signals SVd for one line for each horizontal period (see FIG. 2A).

Figure 2B:
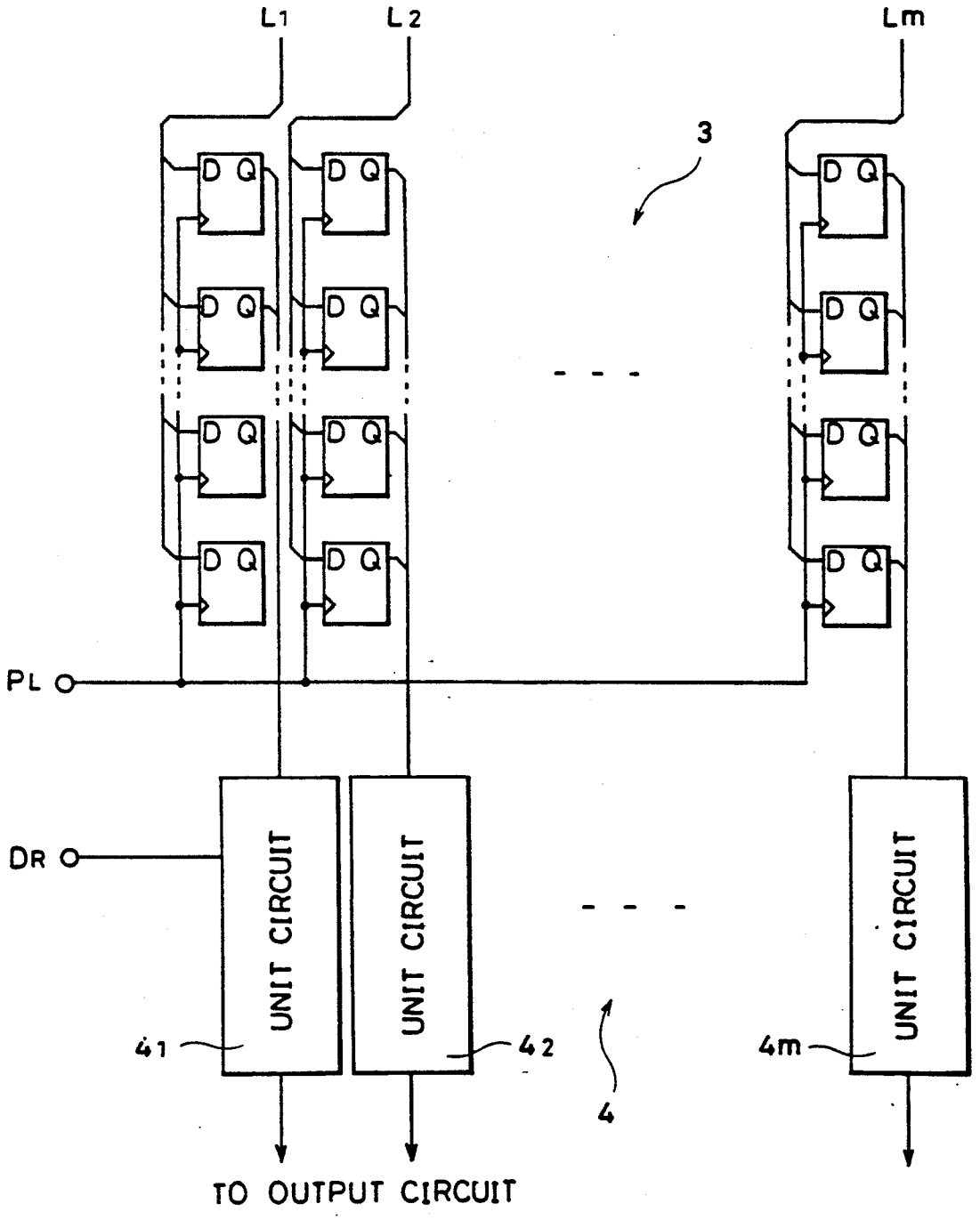

A latch circuit 3 receives the pixel data for one line which are stored in the shift register circuit 2 for each horizontal period (see FIG. 2B). Latch pulses PL are supplied from the timing generating circuit 1 to the latch circuit 3 for a horizontal blanking period so that the pixel data (Ll to Lm) for one line supplied from the shift register circuit 2 are latched and held for a next horizontal period.

A conversion circuit 4 receives the pixel data for one line outputted from the latch circuit 3.

The conversion circuit 4 classifies each pixel data which forms the digital video signals for one line outputted from the latch circuit 3 into upper bits and lower bits respectively, and then selects adjacent two different DC voltages according to a value designated by the upper bits and performs pulse width modulation between the two different DC voltages according to a value designated by the lower bits to supply the analog video signals to the corresponding source lines of the matrix array. In other words, the conversion circuit 4 classifies each pixel data of 8 bits into data DH (D7 to D4) of the upper 4 bits and data DL (D3 to D0) of the lower 4 bits respectively.

The data DH of the upper 4 bits selects adjacent two different voltages VA and VB which are supplied to the source lines of the TFT array 10 among voltages V0 (Vmin), V1, V2, . . . , V16 (Vmax). The voltages V0 (Vmin), V1, V2, . . . , V16 (Vmax) are provided at equal intervals between maximum and minimum voltages Vmax and Vmin. In this case, if a value designated by the data DH is n (n=0 to 15), VA=Vn+1 and VB=Vn.

The pulse width modulation is executed between the voltages VA and VB selected according to the data DL of the lower bits as described above. Then, pulse width modulation signals are integrated and outputted.

Figure 3:
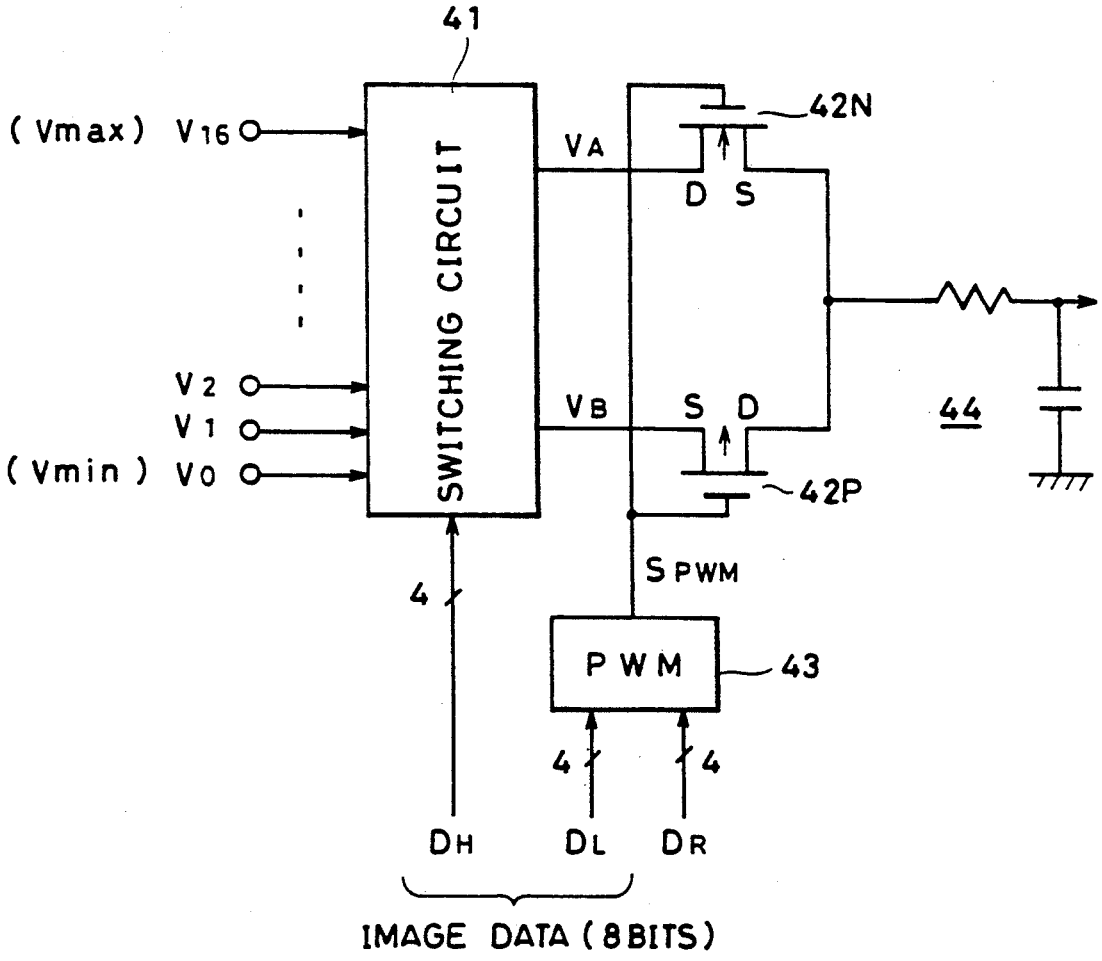
FIG. 3 is a circuit diagram showing the conversion circuit of the embodiment.

The conversion circuit 4 includes unit circuits $4_1$, $4_2$, . . . , 4m which correspond to the number of the pixel data for one line (see FIG. 2B). As shown in FIG. 3, each unit circuit has a switching circuit 41, a pulse width modulator 43, two switching elements 42N and 42P, and an integrating circuit 44. The switching circuit 41 selects the DC voltages. The pulse width modulator 43 compares the lower bits with comparison data DH outputted from a comparison data generating circuit 5 so as to output signals having different pulse widths corresponding to the result of comparison. The switching elements 42N and 42P switch the DC voltages outputted from the switching circuit 41 in response to the signals outputted from the pulse width modulator 43. The integrating circuit 44 outputs the analog pixel signals in response to the signals outputted from the switching elements 42N and 42P.

FIG. 3 is a diagram showing a construction of one pixel portion of the conversion circuit 4.

Figure 4A:
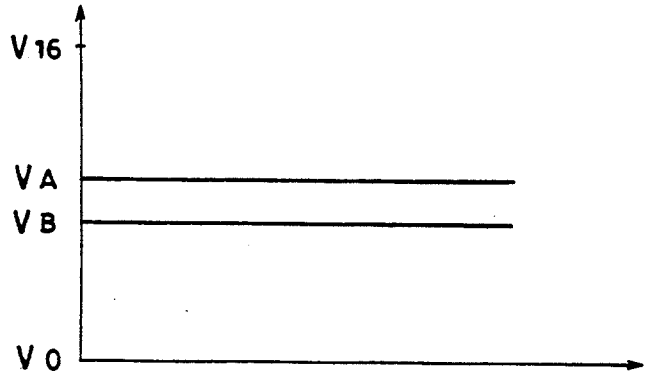
FIGS. 4A, B and C are diagrams for explaining an operation of the conversion circuit.

In FIG. 3, the switching circuit 41 receives the voltages V0 to V16, selects and outputs the voltages VA and VB according to the data DH of the upper 4 bits (see FIG. 4A).

The voltages VA and VB selected by the switching circuit 41 are supplied to a drain of an N-channel FET (field effect transistor) 42N and to a source of a P-channel FET 42P respectively.

The reference numeral 43 denotes a pulse width modulator. The pulse width modulator 43 receives the data DL of the lower 4 bits and the comparison data DR (DR3 to DR0) of 4 bits from the comparison data generating circuit 5 (see FIG. 1). In other words, the comparison data generating circuit 5 outputs the comparison data, which comprises bits by number equal to that of the lower bits, to be compared with the lower bits to the conversion circuit 4.

Figure 5:
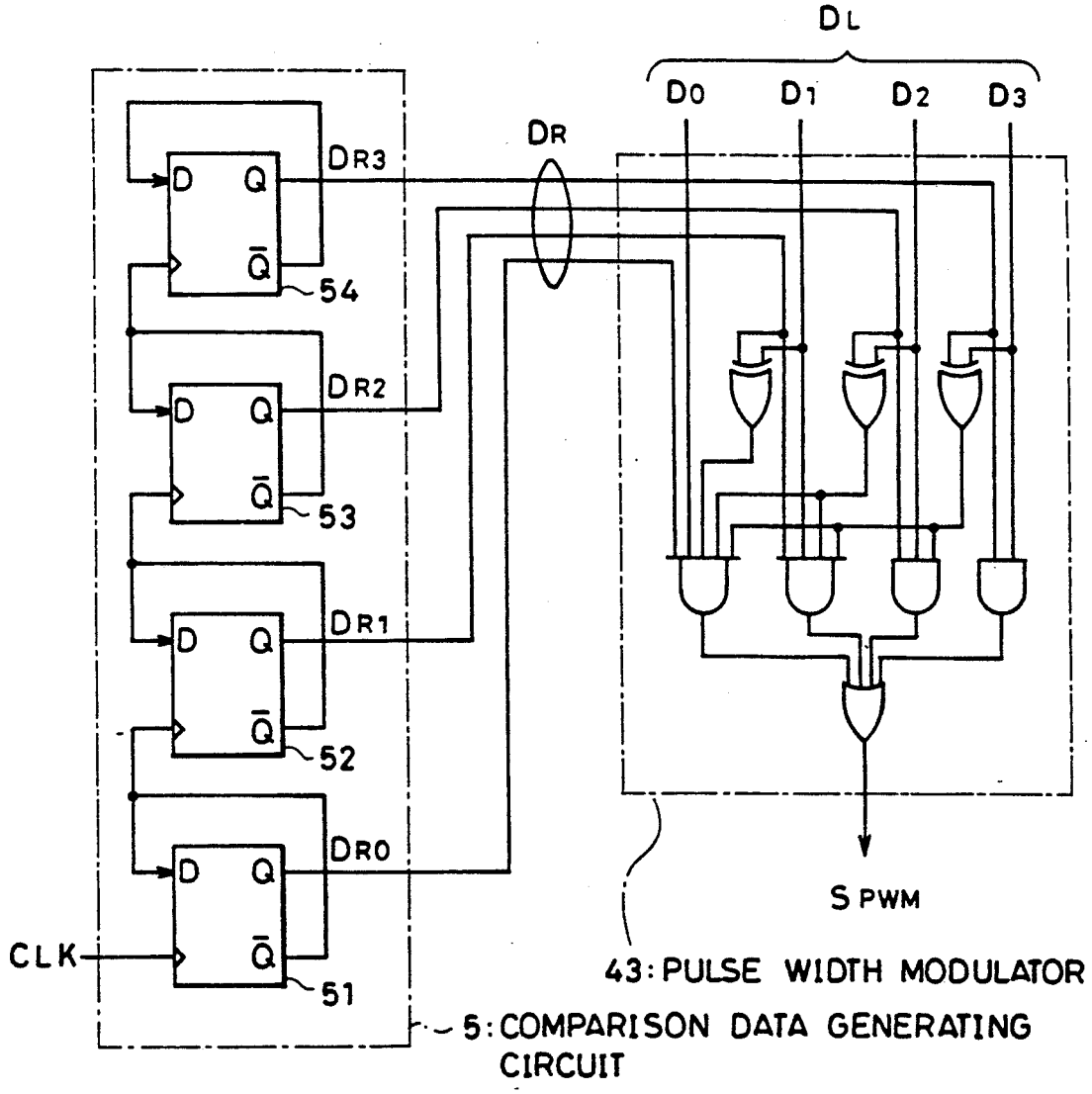
FIG. 5 is a circuit diagram of a comparison data generator and a pulse width modulator of the embodiment.
Figure 6:
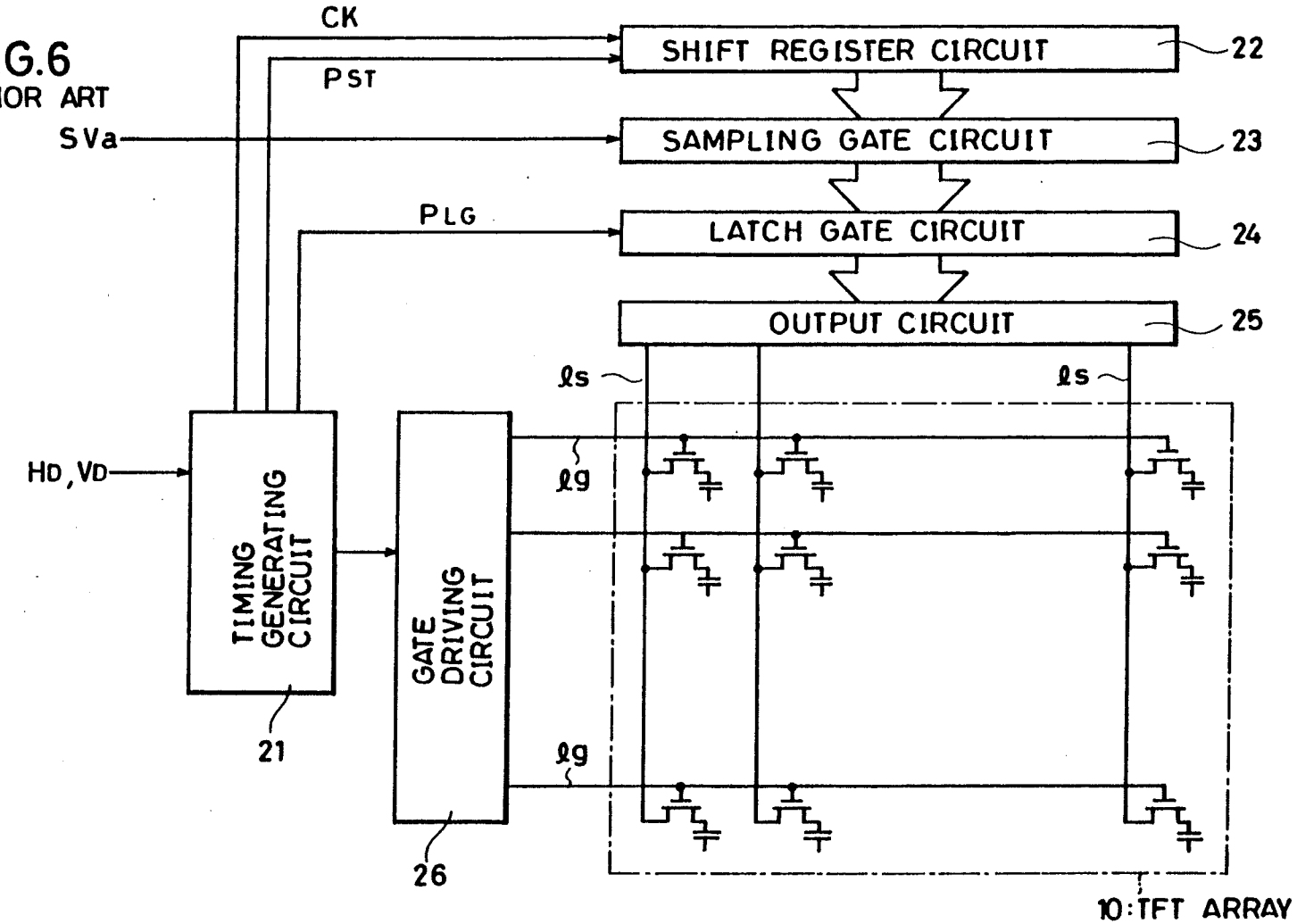
FIG.6 PRIOR ART
FIG. 6 is a block diagram of a conventional example.
Figure 7:
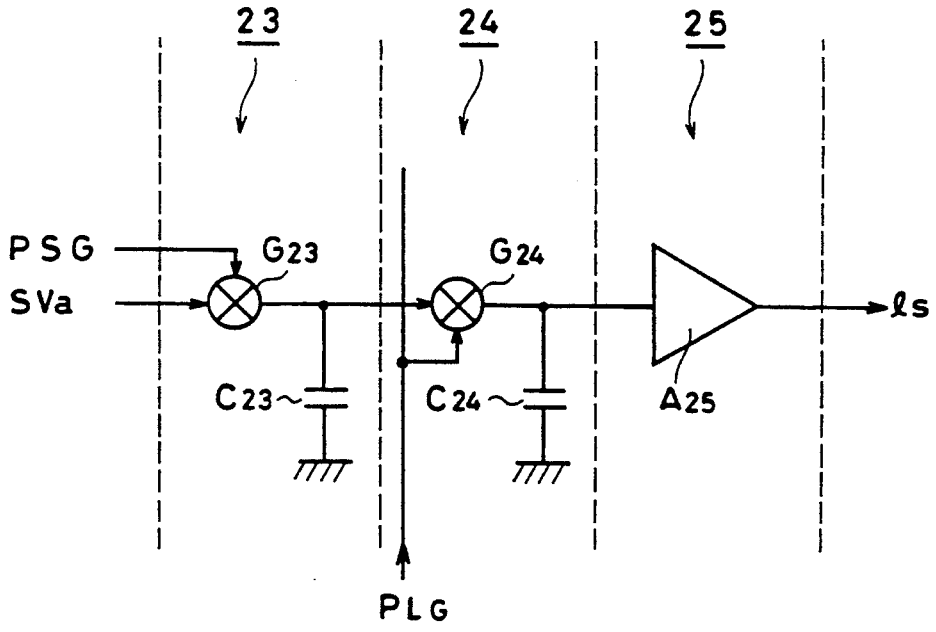
FIG.7 PRIOR ART
FIG. 7 is a circuit diagram of a main portion of the conventional example.

FIG. 5 is a diagram showing a specific construction of the comparison data generating circuit 5 and pulse width modulator 43.

The comparison data generating circuit 5 is a 4-bit hexadecimal counter which is formed by connecting D flip-flops 51 to 54 in series. A clock terminal of the D flip-flop 51 receives the clocks CLK from the timing generating circuit 1. The signals DR0 to DR3 at output terminals Q of the D flip-flops 51 to 54 form the 4-bit comparison data DR. The 4-bit comparison data DR repeats [0000] to [1111] in a cycle for 16 clocks of the clock CLK.

The pulse width modulator 43 is a 4-bit comparator by which the data DL is compared with the comparison data DR. The pulse width modulator 43 outputs signals S PWM. If the data DL is less than the comparison data DR, the signal S PWM has a low level "0". If the data DL is greater than the comparison data DR, the signal S PWM has a high level "1". In this case, every time the clock CLK is supplied to the comparison data generator 5, the comparison data DR is incremented. If the comparison data DR is greater than the data DL, the level of the signal S PWM is changed from the high level "1" to the low level "0". Consequently, a period in which the signal S PWM has the high level "1" corresponds to the data DL in the cycle for 16 clocks of the clock CLK. In other words, the pulse width modulator 43 outputs the signals S PWM which are produced by the pulse width modulation on the data DL.

Figure 4B:
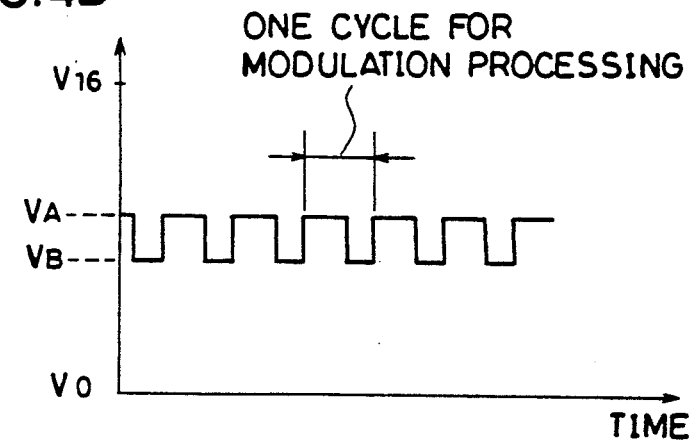

Returning to FIG. 3, the signals S PWM outputted from the pulse width modulator 43 are supplied to gates of the FETs 42N and 42P. In this case, if the signal S PWM has the high level "1", the FET 42N is conductive. If the signal S PWM has the low level "0", the FET 42P is conductive. Accordingly, since the signal S PWM is produced by the pulse width modulation on the data DL, the signals which are produced by the pulse width modulation on the data DL between the voltages VA and VB are outputted to a node of a source of the FET 42N and a drain of the FET 42P (see FIG. 4B).

Figure 4C:
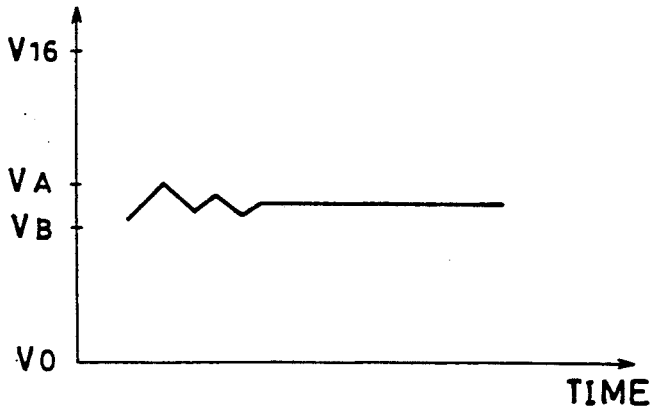

The integrating circuit 44 receives the signals which are produced by the pulse width modulation between the voltages VA and VB. As described above, the voltages VA and VB are selected on the basis of the data DH of the upper 4 bits of the pixel data and the pulse width modulation is performed on the basis of the data DL of the lower 4 bits of the pixel data. Consequently, the signals outputted from the integrating circuit 44 are converted into the analog pixel signals having levels corresponding to the pixel data of 8 bits (see FIG. 4C).

Returning to FIG. 1, the conversion circuit 4 outputs analog pixel signals which have levels corresponding to the digital pixel data for one line supplied from the latch circuit 3. The analog pixel signals are simultaneously supplied to the corresponding source lines ls of the TFT array 10 through the output circuit 6 respectively. The output circuit 6 is a voltage follower which is connected every source line.

The reference numeral 7 denotes a gate driving circuit. The gate driving circuit 7 receives control signals from the timing generating circuit 1. Scanning pulses are sequentially supplied to the gate lines lg. The gate lines lg are arranged in positions corresponding to the pixel signals for one line which are supplied from the output circuit 6 to the source lines ls of the TFT array 10 for each horizontal period.

Thus, the digital video signals SVd for one line are sequentially stored in the shift register circuit 2, held by the latch circuit 3 for one horizontal period and then converted into the analog video signals by the conversion circuit 4 so as to be supplied to the source lines ls of the TFT array 10. In addition, the scanning pulses are sequentially supplied to the gate lines lg. The gate lines lg are arranged in the positions corresponding to the video signals for one line which are supplied to the source lines ls of the TFT array 10. Each pixel of the TFT array 10 is driven in response to the analog pixel signals corresponding to each pixel data of the video signals SVd so that an image is displayed.

According to the present embodiment, there is not performed a processing in which the pixel signals are sampled from the analog video signals SVa. Consequently, even if the number of the pixels for one line is increased, the TFT array can sufficiently and accurately be driven corresponding to the video signals SVd.

As described above, the comparison data DR is compared with the data DL so that the pulse width modulation is performed. The comparison data DR is synchronized with the clock CLK so as to be sequentially increased by a quantize step width. It is required to repeat the pulse width modulation about 10 times for one horizontal period so as to obtain the stable analog video signals.

According to the present embodiment, the pulse width modulation is performed between the voltages VA and VB by the data DL of the lower 4 bits. Consequently, the time for one pulse width modulation can be reduced as compared with the pulse width modulation by the pixel data of 8 bits itself. For the pulse width modulation by the pixel data of 8 bits itself, the time for 10 pulse width modulations is 10 nsec$\times$256 steps$\times$10 times$=$25.6 $\mu$sec if the cycle of the clocks CLK is 10 nsec. For the present embodiment, the time for 10 pulse width modulations is 10 nsec$\times$16 steps$\times$10 times$=$1.6 $\mu$sec if the cycle of the clocks CLK is 10 nsec. Accordingly, a construction of the present embodiment causes the cycle of the clocks to be longer. In addition, even if a cheap clock generator is used, the pixel data can be converted into the analog video signals very well.

While the pixel data of 8 bits is classified into the data of the upper 4 bits and the data of the lower 4 bits in the present embodiment, the division of the number of the bits is not limited. In other words, the division is determined in consideration of the cycle of the clocks CLK or the like. Briefly, the bits of the pixel data are divided into the upper 4 bits and the lower 4 bits to reduce the number of the bits related to the pulse width modulation.

While the pixel data of 8 bits are used in the above present embodiment, the number of the bits of the pixel data is not limited. If the number of the bits is increased, the present invention becomes more effective.

According to the present invention, the digital video signals are used as described above. Unlike the conventional example, there is not performed a processing in which the pixel signals are sampled from the analog video signals. Consequently, even if the number of the pixels for one line is increased, the TFT array can sufficiently and accurately be driven corresponding to the video signals. In addition, the pixel data is classified into the data of the upper and lower bits. The adjacent two different DC voltages are selected according to the data of the upper bits. The pulse width modulation between the two different DC voltages are executed according to the data of the lower bits. Consequently, even if the number of the bits of the pixel data is greater, the time for the pulse width modulation is rarely increased. Therefore, the cycle of the clocks may be longer. In other words, even if the number of the bits of the pixel data is increased, the pixel data can be converted into the analog video signals very well by using a cheap clock generator.

What is claimed is:

1. A driving circuit of a liquid crystal display for driving source lines of an active-matrix type liquid crystal display having a thin film transistor matrix array comprising:

a shift register circuit for sequentially storing digital video signals for one line, each of the digital video signals being comprised of pixel data of a series of predetermined bits;

a latch circuit for holding, for one horizontal period, the digital video signals for one line stored in the shift register circuit;

a conversion circuit for classifying each pixel data constituting the digital video signals for one line outputted from the latch circuit into upper and lower bits, selecting adjacent two different DC voltages according to a value designated by the upper bits, performing pulse width modulation between the two different DC voltages according to a value designated by the lower bits and supplying analog video signals to the corresponding source lines of the matrix array; and a comparison data generating circuit for outputting comparison data which has bits by number equal to that of the lower bits and is compared with the lower bits to the conversion circuit.

2. A driving circuit according to claim 1 wherein the conversion circuit includes unit circuits by number corresponding to that of the pixel data for one line, the unit circuit having a switching circuit for selecting the two different DC voltages, a pulse width modulator for comparing the lower bits with the comparison data outputted from the comparison data generating circuit and then outputting signals which have different pulse widths corresponding to the result of comparison, two switching elements for respectively switching the two different DC voltages outputted from the switching circuit in response to the signals outputted from the pulse width modulator, and an integrating circuit for outputting analog pixel signals in response to the signals outputted from the respective switching elements.

3. A driving circuit according to claim 2 wherein the pulse width convertor is a 4-bit comparator and the comparison data generating circuit is a hexadecimal counter which is formed by connecting four D flip-flops in series.

4. A driving circuit according to claim 2 wherein the switching elements are N- and P-channel field effect transistors.

5. A driving circuit according to claim 1 wherein the comparison data generating circuit is a hexadecimal counter which is formed by connecting four D flip-flops in series.

* * * * *